US005441249A

United States Patent [19]

Todaro et al.

[11] Patent Number: 5,441,249

[45] Date of Patent: Aug. 15, 1995

[54] METHOD AND DEVICE FOR SEPARATING LIFTS FROM A STACK OF SHEETS

[75] Inventors: Frank A. Todaro, Old Saybrook; Peter D. Hotkowski, Chester; Charles M. Chadwick, Old Saybrook, all of Conn.

[73] Assignee: Asterisk, Inc, Old Saybrook, Conn.

[21] Appl. No.: 995,205

[22] Filed: Dec. 22, 1992

[51] Int. Cl.[6] ..... B65H 3/10

[52] U.S. Cl. ..... 271/107; 271/118; 271/126; 414/798.9; 414/786

[58] Field of Search ..... 271/107, 112, 113, 115, 271/118, 119, 120, 126; 414/798.9, 786

[56] References Cited

U.S. PATENT DOCUMENTS

| | | | |
|---|---|---|---|
| 3,391,806 | 7/1968 | Geis et al. | 414/798.9 |
| 3,627,152 | 12/1971 | Pfäffle . | |
| 3,690,475 | 9/1972 | Pfäffle . | |
| 3,757,970 | 9/1973 | Pfäffle . | |
| 4,286,908 | 9/1981 | Pfäffle . | |
| 4,484,735 | 11/1984 | Goi | 271/107 X |
| 4,928,944 | 5/1990 | Golicz | 271/6 |
| 5,064,183 | 11/1991 | Nishigaki et al. | 271/107 X |
| 5,072,921 | 12/1991 | Golicz | 271/35 |
| 5,096,176 | 3/1992 | Golicz et al. | 270/95 |

FOREIGN PATENT DOCUMENTS 765303 8/1967 Canada ..... 271/107

OTHER PUBLICATIONS

GBR Systems Corp. "Smart Feeder Folder Cut Sheet System 420" (Unknown Date) 2 pg.

Intelligent Technologies Corp. Brochure (Unknown Date) 6 pg.

Mathias Baverle GmbH "Operating Instructions for Synchronised Sheet Feeder" (Unknown Date) 1 pg.

*Primary Examiner*—Michael S. Huppert
*Assistant Examiner*—Janice L. Krizek
*Attorney, Agent, or Firm*—C. Nessler

[57] ABSTRACT

Lifts or sets of precise count are withdrawn from a stack of sheets. A reciprocating vacuum head serially pulls away sheet corners from the stack. Each sheet is stripped from the head and held by the backside of the head at a holding zone axially spaced apart from the stack until the desired quantity in the set is accumulated. A wedge then interposes in the space between the set of restrained corners and the rest of the stack, to bend the upper half of the sheet set away from the stack while the rest of the set remains in contact with the stack. Then nip rollers engage the bent away parts as a set and draw away the whole of the set transversely.

17 Claims, 3 Drawing Sheets

METHOD AND DEVICE FOR SEPARATING LIFTS FROM A STACK OF SHEETS

TECHNICAL FIELD

The invention relates to the providing of lifts, or sets of paper sheets, from a stack, especially where each lift must have a precise number of sheets.

BACKGROUND

The invention is particularly useful as part of document processing, in which individual paper sheets are printed, most often by laser printing, and must be thereafter assembled into bound documents. Typically, an electrostatic laser printer provides a large stack of collated sheets comprising identical or dissimilar multipage documents, and they must then be separated into their appropriate sets and delivered to a binding machine. For example, each document might be a customized employee benefit statement with internal sections varying in length according to the employee. The problem is to rapidly identify where one document ends and the other begins, and to deliver the lifts in nicely aligned fashion, all at high speed commensurate with the output of modern printers, binding machines and associated equipment.

A rather basic way of providing lifts is to have an operator look manually through the stack for the end of a document and remove the set by hand. More efficiently, high speed machinery has been used to slide the sheets one by one laterally from the stack, to pass them along a conveyor where each sheet is counted or optically inspected, and to deliver sheets to an assembly point where they are jogged into alignment as a lift. In accomplishing such, sheets will be drawn from the end of the stack variously, as by vacuum devices or frictional belts and rollers. See, for example, U.S. Pat. No. 4,928,944 to Golicz. This method is attractive in that each sheet can be scanned as it is removed and the beginning and ends of documents can be identified to form accurate lifts. However, the single sheet separation and assembly method is limited in document production rate because of practical limits of aerodynamics and sheet stiffness on the lateral translation speed of sheets. It is also disadvantageous in that the sliding of sheets by each other creates friction and static electricity; in turn, this may disrupt jogging sheets into re-alignment and may cause electrostatic copier toner transfer.

Other equipment is known which provides lifts without removing single sheets, especially certain devices patented by Pfaffle, as follows. U.S. Pat. No. 3,690,475 shows how a wedge is forced into the side of a vertical stack to define a known length of the stack as a lift which is then pushed out of the stack sideways. In the device of U.S. Pat. No. 3,627,152 a finger and disk enter the corner of a vertical stack and a lift is dropped downwardly onto a conveyor. However, even if the machinery is accurate, slight variations in the thickness or lay of the paper will cause variations in the number of sheets which are removed with each set. U.S. Pat. No. 4,286,908 describes an accessory for compressing a corner to reduce the variations. Thus, defining a thickness of a stack is not a means that can be counted on for precision count. And, it would appear that sheet edges might be hit and damaged from time to time. Certainly, the stack-length measuring method is not particularly adaptable to situations where the documents vary in number of sheets within the stack, or where the thickness of the paper varies within or from one document to the next.

Thus, there is a need for improvement in the method and apparatus by which stacks are separated into lifts. Whatever equipment may be used, it is of course important that minimum operator labor be required to operate the machine. Machines that need constant reloading or adjustment are undesired. Other considerations include simplicity of operation, low maintenance and low capital cost.

SUMMARY OF THE INVENTION

An object of the invention is to form a stack into lifts of precise and known count, when the stack is comprised of documents of similar or varied length. A further object is to create lifts with economy and great speed.

In accord with the invention, first parts of successive sheets of a stack are serially bent away axially and held in a holding zone. A set of n sheet first parts is accumulated, while the remainder parts of the sheets are kept in position in the stack. Then, the set of sheet first parts in the holding zone is drawn away as a set, drawing with it from the stack the remainder parts of the sheets of the set. Preferably, the first parts of sheets that are pulled are corner parts, and after the first parts are accumulated in the holding zone, a set of second sheet parts, being the rest of the n sheets comprising their nominal upper halves, is moved as a set toward the holding zone; then the whole set is drawn away transversely to the stack by nip rollers which engage the parts in the holding zone.

In a preferred embodiment, the stack is fed along a base sloped slightly below horizontal, to a stop having fixed and movable parts. The corners of the upper ends of successive sheets are serially bent away from the stack by a reciprocating head having a vacuum ported concave surface and a rotatable stripper bar. After being stripped from the vacuum surface side of the head, the sheet parts are held in the holding zone by the backside of the head. When the desired quantity of n sheet first part corners is accumulated in the holding zone, a wedge is interposed in the space between the nth sheet corner and the rest of the stack, to bend more of the sheets—the nominal upper half of the sheet set which includes the first part corners—away from the stack and toward the holding zone. A hinged portion of the stop bends away to enable this further separation of the sheet set from the stack. Rollers attached to the wedge move toward rollers near the bent over hinged stop, to form a nip roller set which pinches the n sheets together. Rotary actuation of the nip rollers withdraws the set bent over parts and the integral remainder parts of the sheets transversely from the stack. A sensor on the head enables optical reading of information on the sheets as their parts are being moved to the holding zone, to enable determination of when a set is complete.

The invention provides lifts of accurate count, and since they are removed as intergral sets, minimal subsequent jogging is required to put them in alignment for further processing. Since sliding of one sheet over another is greatly reduced, there is little adverse interaction of one sheet surface with the next. Since wasted motion is avoided, the output of the apparatus is high. Since the stack is preferably fed along the base at a slight angle below the horizontal, the stack may be quite long, and minimal operator attention is required during operation.

The foregoing and other objects, features and advantages of the invention will become more apparent from the following description of the best mode of the invention and accompanying drawings.

DESCRIPTION OF THE PREFERRED EMBODIMENTS

The invention is described in terms of producing lifts, or sets, of n sheets from a stack of paper sheets, 8.5×11 inch in dimension and 24 lb bond in weight. The quantity n is 1 or greater; typically it will be 5–40. First parts, preferably corners, are first serially pulled from the stack to a holding zone, to produce a set of sheets restrained by corners. The set is then further separated from the stack by a wedge which interposes in the space between the nth sheet and the stack, to bend away from the set a second part of the set, so that approximately half the sheet set is bent away from the stack. Then, the whole set is drawn transversely from the stack, as an aligned set, by rollers.

Figure 1:
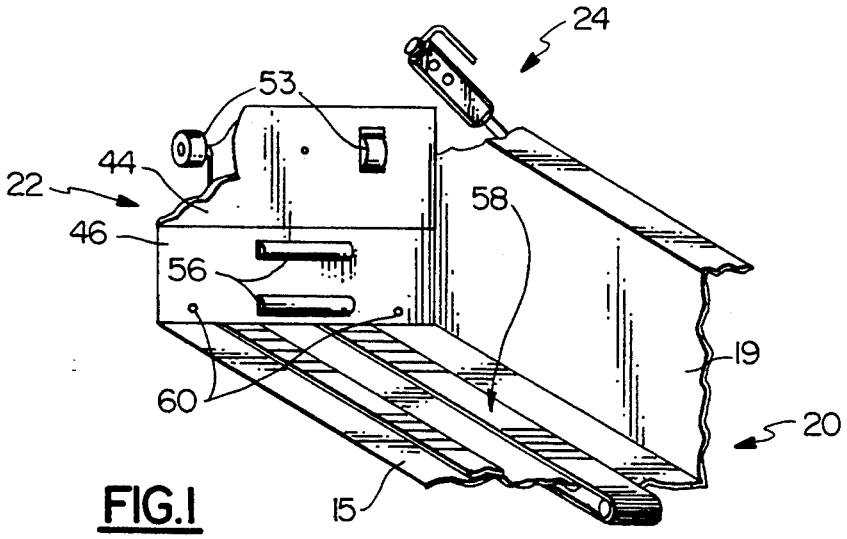
FIG. 1 is a perspective view of the apparatus showing a base bottom having moving belts, upon which the stack may lie, and a hinged stop plate and head.
Figure 2:
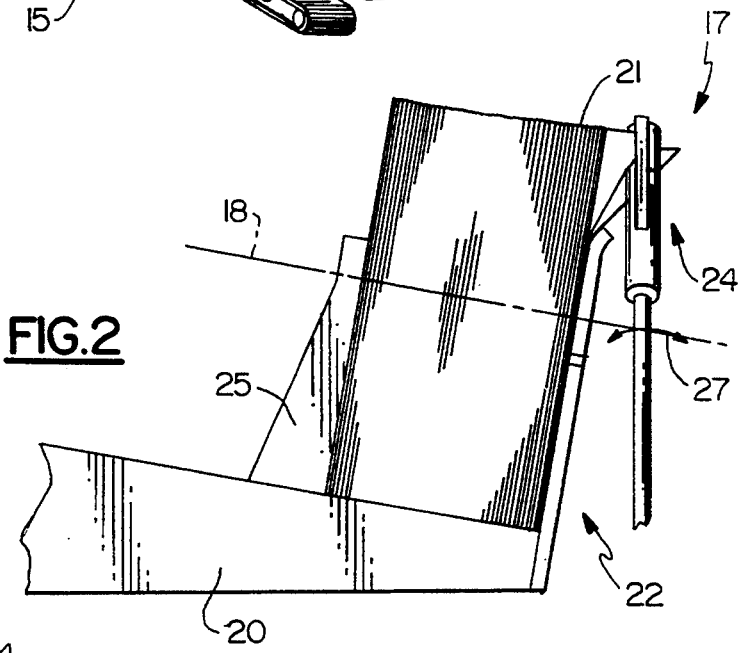
FIG. 2 is a side view of the base and stop, showing how the head separates successive corner parts of the sheets of the stack.
Figure 3:
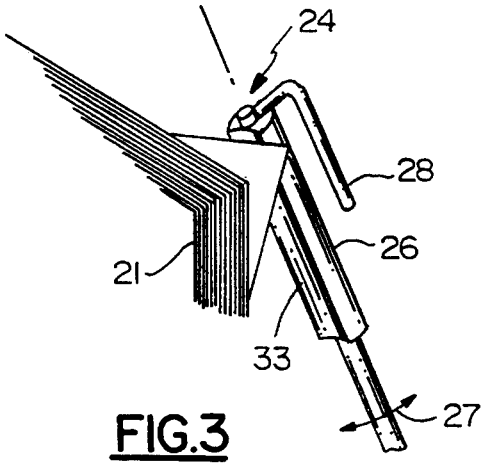
FIG. 3 is a perspective view showing the head and stripper bar in operation as the head pulls a sheet from the stack.

As illustrated by FIG. 2, a stack 21 of sheets has an axis 18 perpendicular to the faces of the sheets. The stack is fed axially along a base 20 sloped at about 10 degrees below horizontal toward a stop 22 as shown in FIG. 1. The sheets are kept aligned by the bottom 15 and side 19 parts of the base, combined with the axial pressing force of the end plate 25 toward the stop, as described further below. In the vicinity of the stop is a separation zone where the stack is acted on by the machine parts that separate and count the sheets.

First, a movable head and stripper bar assembly 24 pulls a first part, the corner, of each successive sheet from the end of the stack and restrains each in a holding zone 17 axially spaced apart from the stack. This is illustrated by FIGS. 2–5. The semi-cylindrical head 26, made of $\frac{3}{4}$ inch diameter acetal plastic is fixedly mounted on inclined hollow shaft 30. The head has a $\frac{1}{4}$ inch diameter vacuum port 32, so that when the head is brought close to the corner of a sheet at the end of the stack, atmospheric pressure causes the sheet to press against the $\frac{3}{8}$ by $1\frac{1}{4}$ inch surface of a chordal side 33 running lengthwise along the head. The surface is slightly concave to facilitate drawing only one sheet at a time. The port 32 is connected by a line running down the shaft to a vacuum pump where a bleeder regulates the vacuum at about 8–15 torr. The head has an optical sensor 34 for reading any information on a sheet surface which it approaches, e.g., to identify that the sheet is the nth sheet, or the last of a desired document, and for sending a signal to the apparatus control system, and thereby institute the other steps described further below.

As the sheet is held by atmospheric pressure to the head's side, the head moves from the stack axially along a slightly curved path indicated by the arrow 27, bending the corner of the sheet away from the stack as shown in the Figures. The shaft 30 lies in a plane parallel to the end of the stack and is at about 45 degrees to the side 19 of the base. The shaft is mounted off an unshown planetary gear, driven by a sun gear which in turn is driven by a stepper motor. The head moves along a short arc of about $\frac{3}{4}$ inch length and 1.5 inch radius, following a path approximately indicated by the arrow 27. The head drive mechanism provides a varying speed to the head so that it approaches and leaves the end of the stack at low speed, while the stripper bar described below rotates at a high speed. Corners of sheets are pulled at the rate of 1–10/s. Of course, while we use a combination of stepper motor and gears, various other drive mechanisms may be used to move the head and stripper bar, including combinations involving pneumatic devices, linear motors, cams, etc.

The 45 degree head-shaft inclination is somewhat adjustable, and the orientation of the head side surface 33 and port with respect to the stack may be rotatably adjusted, to optimize the ability and speed of the head's pulling, especially when the paper character is changed from job to job.

Figure 4:
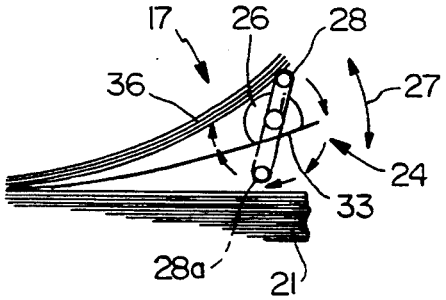
FIG. 4 is an end on view of the head and stripper bar, showing how the stripper bar rotates, and how the head restrains the pulled away corners at a holding zone spaced apart from the stack.
Figure 5:
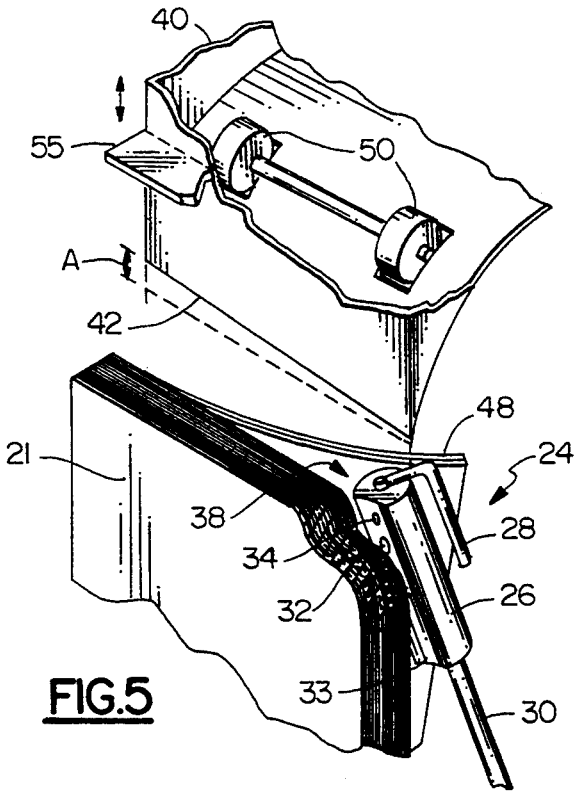
FIG. 5 is a perspective view showing how the head holds a set of corners spaced apart from the stack and how a wedge moves vertically down to interpose into the space between the pulled away sheet corners and the rest of the stack.

A L-shaped heavy steel wire stripper bar 28 is rotatably mounted at the top end of the head. As the head draws a corner of the sheet away from the stack, the stripper bar rotates 360 degrees around the circumference of the head, as illustrated by FIG. 4. The bar 28 is powered by a drive running inside the shaft and head connected to the same drive mechanism which causes the reciprocation of the head. When the stripper bar rotates clockwise to the position 28*a* indicated in phantom, the stripper bar contacts the sheet held at the surface of the head; continued rotation pulls the sheet away from the head flat side and thrusts it behind the head to be held with any other previously accumulated sheets 36 in the holding zone 17. The head's placement, even while it reciprocates axially to and fro, holds the accumulated pulled and stripped sheets in the holding zone. As the stripper bar strips a sheet from the flat side of the head, and continues rotating along its circumferential arc portion which is furthest from the stack end, the head repeats its motion by moving toward the stack end, to draw the serially next sheet from the stack. Such repetitive motions are continued until the desired set of n sheet corners is accumulated and held in the holding zone. The quantity n will either be determined by prior programming or by signal from the aforementioned head sensor. Then to enable the next step to be carried out, the head temporarily ceases its motion, stopping at a rest position in contact with the stack and sheet n+1(i.e., the first sheet of the next lift), and with the stripper bar stopped at a position furthest removed from the stack end, as shown in FIG. 5.

Figure 7:
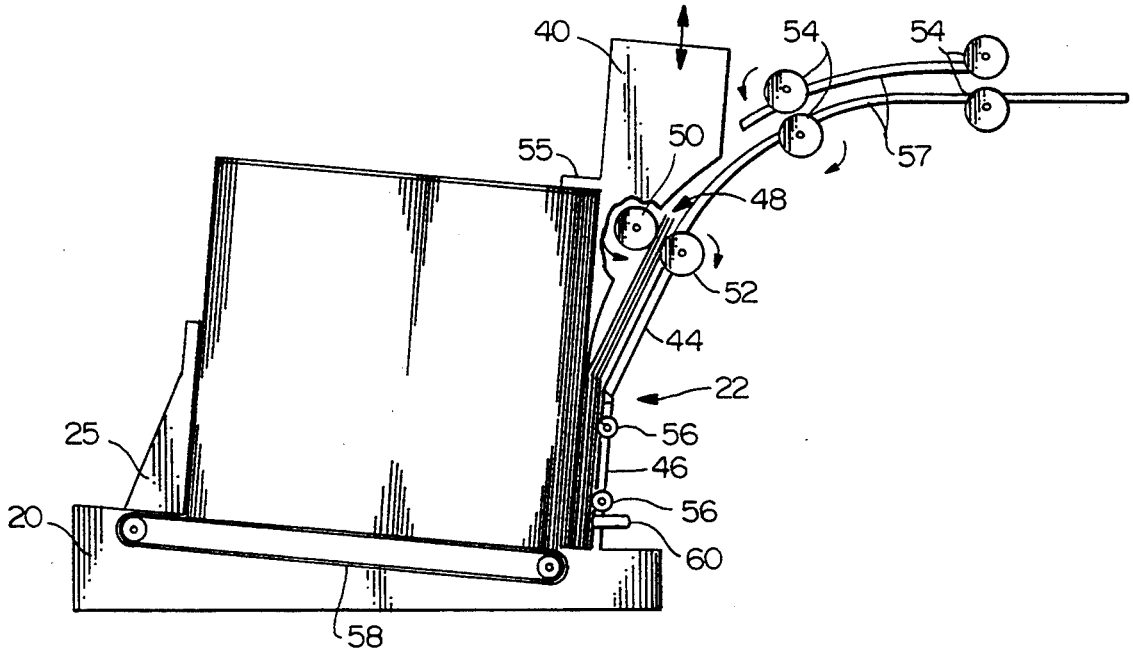
FIG. 7 is a side view like FIG. 6, showing the wedge fully inserted between the set and the stack, where the rollers on the wedge and their mates form a nip that draws the set from the end of the stack.
Figure 6:
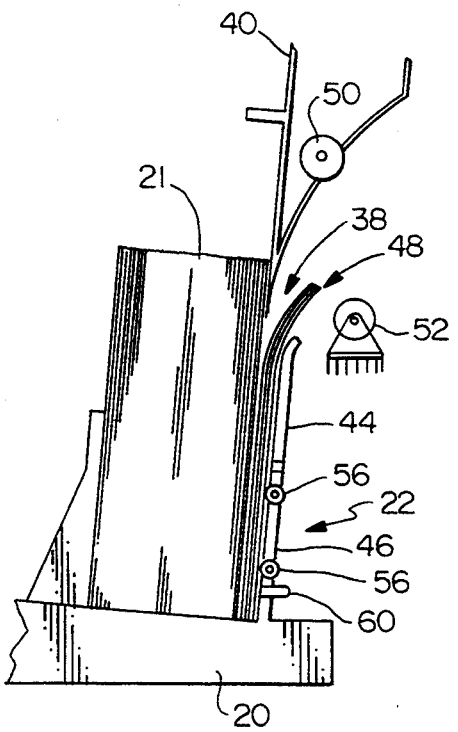
FIG. 6 is a side view showing how the wedge moves into the space between the corners and the stack. The head is not shown, for clarity.

In the next step a wedge separates second sheet parts as a set from the end of the stack. For a sheet, the second sheet part comprises the other corner at the end of the sheet, so that the separated second part and first part together comprise about one half of the upper end of the sheet. During this step the remainder or lower parts of the sheets of the set remain fixed in position in the stack, due to both not being acted upon and due to the frictional forces from the base sides and the rest of the stack pressing toward the stop. FIGS. 5 and 6 show how the wedge 40 is positioned to move vertically downward and interpose within the space 38 between the restrained set 48 of sheet corners and the remainder of the stack. The blunt knife edge 42 is sloped along the wedge length, at about a 10 degree angle so the wedge first enters the space 38 near the head. The wedge 40 is shorter in horizontal length, at about 7 inches, than the width of the sheets, so the wedge does not hit the now-stationary head. Continued wedge down-motion gently pushes the nominal top half end of the sheet set axially away from the stack toward the holding zone. FIG. 7 shows the wedge at its maximum downward travel. It also illustrates that the stop 22 has two portions. The lower portion 46 is fixed perpendicularly to the base; the upper part 44 is hinged. Not shown is a cam roller attached to the wedge which biases the upper part 44 toward the stack when the wedge is in its uppermost position. When the wedge moves downwardly to push the second part of set 48 away from the stack end, the stop part 44 hinges away. The wedge moves downwardly by gravity force until the downward motion of the wedge is stopped by rollers 52 as described next.

In the next step, the set is drawn vertically upwardly and transversely to the stack by a combination of rollers called nip rollers, to remove it from vicinity of the base and separation zone. From FIGS. 5–7 it is seen that the wedge has idler rollers 50 that contact the sheet set 48; and, as the wedge is lowered, they capture, or nip, the set by pushing toward mating driven rollers 52 which protrude through openings 53 of the hinged plate part of the stop. See FIG. 1. The driven rollers are No. 40–50 Durometer urethane and the mating idler rollers are harder acetal plastic. The rollers are mounted on the apparatus and motor driven in conventional ways. The wedge pushes the first sheet (lying against the stop 44 and rollers 52) and the nth sheet (contacting the wedge rollers 50) toward each other with a force sufficient to enable drawing the set from the stack when the rollers are driven. That is, the force between the opposing nip rollers is sufficient to create enough friction amongst the n sheets, and between the first sheet and the driven rollers, so as to overcome the friction forces between the nth sheet and the stack, the first sheet and the stop, and the set as a whole with other apparatus parts which contact it. Thus, as the drive rollers rotate in the way indicated by arrows they draw the remainder parts of the sheet set from between the stack end and the stop, pulling it vertically upward, to remove it from the separation zone and deliver it as a lift to outfeed rollers 54 and an associated guide system 57, whereafter other operations may be performed on the lift. It will be appreciated that in the foregoing process there is negligible relative motion between the sheets of the set/lift, and thus little jogging is required downstream of the outfeed rollers for perfect alignment of the lift of sheets. Of course, which rollers are idlers and which are driven may be made different than described, and other means, such as belts, can be substituted for rollers as are known in the art for moving sheet sets.

The wedge has a spring steel tab 55 which contacts the remainder of the stack when the wedge is lowered. The tab prevents any tendency for the n+1 sheet, next in the stack, to be drawn upwardly with the desired set of whole sheets, or lift.

After a lift is drawn from the end of the stack, the wedge withdraws to a position above the stack; axial force pushes the stack down the slope, so the stack end contacts the stop; the head then resumes its motion and the process is repeated again to create the next lift.

FIGS. 1 and 7 illustrate other aspects of the apparatus. To aid in the drawing of the remainder sheet parts of the set from between the stack and stop, rollers 56 are positioned to slightly project through the surface of the fixed part 46 of the stop. As an alternative, other friction reducing means such as slippery plastic surfaces and air films may be used.

For advancing the stack along the base toward the stop, endless belts 58, driven by an unshown motor, move lengthwise across the surface of the bottom 15 of the base. End plate 25, a relatively heavy piece of aluminum, is laid on the belts and base at the back end of the stack. Thus, motion of the belts engages both the sheet edges and the end plate, to press the stack toward the stop 22. The downward slope of the base bottom makes it convenient to momentarily remove the end plate and insert additional sheets at the end of the stack without disrupting the action of the machine, since the sheets will tend to stay in place rather than fall over. Of course, other means such as a ram may be used for moving the stack, and the machine may be operated with the sheets in other positions than essentially horizontal, though less conveniently; for example, vertically up. The base is shown with only a bottom and one side; additional guides and other configurations to hold the stack may be employed.

Ball-end spring loaded sensors 60 are mounted in the fixed part 46 of the stop to signal the presence or absence of the stack. When a set/lift is removed by the nip rollers, the sensors 60 signal the absence of the stack to the control system and the belts are then actuated to drive stack and end plate toward the stop.

Figure 8:
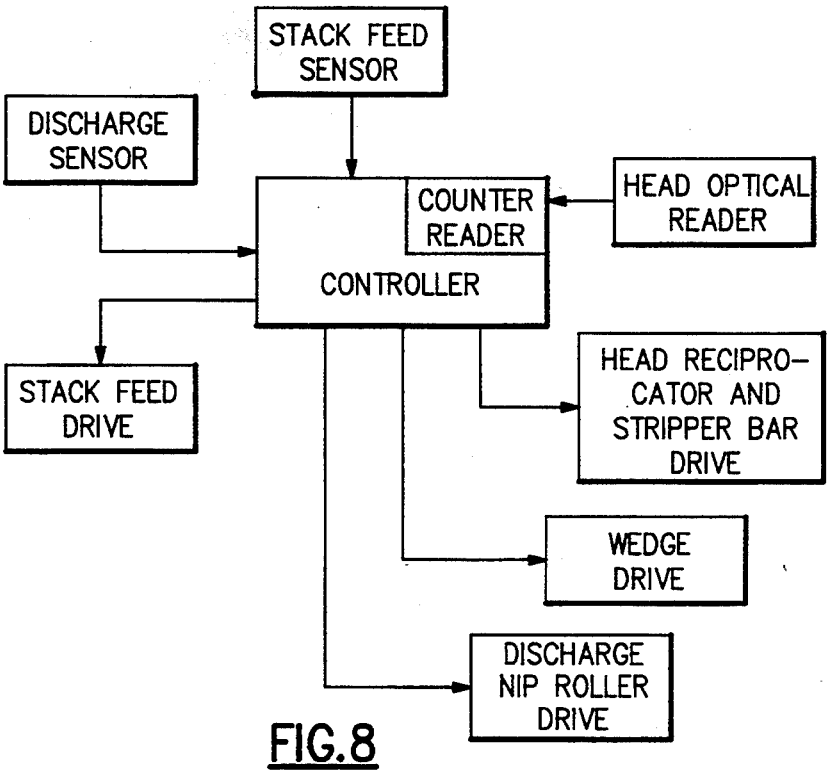
FIG. 8 is a schematic of the control system.

The apparatus allows for the ordinary adjustments expectable in a complicated mechanical device, including those for speed and force. The apparatus is controlled by a central processor as schematically illustrated by FIG. 8. There are appropriate suitable sensors to detect completions of motions, jamming and the like. In developmental devices, the apparatus has a capacity to produce sets of 1–40 pages 8.5×11 inch dimension, and to process 20,000 or more sheets per hr when each lift has 10 sheets.

Other embodiments are within contemplation and within the scope of the invention. While the preferred way of removing the lift from the stack is transversely, as described, the lift may alternately be removed axially. This is accomplished in a modification of the apparatus described above. The stop 22 is translated or folded out of the way to provide room. Then the bent away portion of the set is mechanically grasped, to turn and draw the set axially, delivering it thereafter to nip rollers spaced apart from the stack end. Then the stop is restored to its original position. During the temporary stop removal, the rest of the sheets of the stack is restrained by fingers interposed between the set and the remainder of the stack, or other means.

Figure 9:
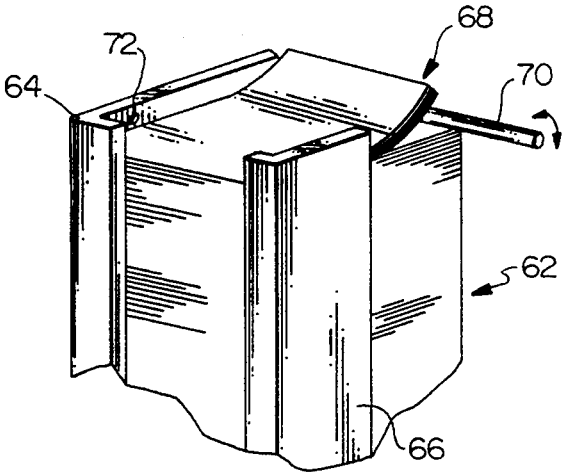
FIG. 9 shows in perspective an alternate embodiment, wherein a stack is fed vertically upward to a separation zone where sheet first part half ends are drawn away by a long vacuum head.

In other modes, the stop and other mechanisms may be translated toward a stationary stack, rather than the stack moving toward them. In still other embodiments, the first part may comprise the entire upper quarter or half of the sheet end. This can be drawn away by a multiplicity of vacuum heads, or a horizontal vacuum head lying parallel to the top end of the sheets as shown in FIG. 9, discussed below. After n sheets are held in the holding zone, such head or heads is withdrawn to enable rollers or other mechanism to nip or grasp the end of the set and withdraw the set from vicinity of the stack. In still another embodiment, the sheet set can be withdrawn by grasping or nipping the bent away set of sheet first part corners only without the wedging away of second parts; but our judgement is that the combination of first part and second part bending provides on balance for simpler motions and mechanism.

The apparatus may be configured without a stop in some embodiments, although we prefer the positive aspect of a stop. For instance, in FIG. 9 there is gravity force on the top sheets of a stack 62 fed vertically upward; this combines with friction of the sides 64, 66 of the base to keep the remainder parts of the sheets in place with the stack as the horizontal head 70 bends away the nominal half-end of each sheet, to accumulate the end parts as a set 68 in the holding zone. The means for drawing away the whole set from the stack is not shown, but may comprise rollers like those described or mechanical fingers, etc., to draw the set transversely or vertically. A position sensor 72 mounted in the base side 64 is employed to signal when the stack has been sufficiently advanced vertically, after the desired set is removed.

Other variations on the head and first part restraining means are feasible. Instead of vacuum attraction to the head, other attractions or means can be used to draw the sheets away. For example, a releasable adhesive or electrostatic attraction may be used. Another alternative is to pull each sheet first part away with mechanical fingers, preferrably after first causing slight buckling of each sheet, by such as a rubber roller, to facilitate interposition of the fingers between the sheet and the rest of the stack. Instead of a stripper bar mounted on the head, a separate interposing finger or other mechanism may be used to hold the first sheet parts in the holding zone. Likewise, an arm or a rubber side plate, may be used to hold the sheet parts in the holding zone.

Although only the preferred embodiment has been described with some alternatives, it will be understood that further changes in form and detail may be made without departing from the spirit and scope of the claimed invention.

We claim:

1. Apparatus for separating a lift of n sheets from a stack of sheets, the stack having an axis perpendicular to the faces of the sheets, comprising a base, for supporting a stack of sheets;

a stop, mounted on the base;

means for axially feeding the stack of sheets along the base, so an end of the stack contacts the stop;

means for serially bending from the end of the stack in the direction of axial feeding, first parts of successive sheets of the stack, and for delivering each sheet first part to a holding means;

holding means, for receiving and retaining the bent away first parts of the sheets at a holding zone axially spaced apart from the end of the stack, to enable accumulation of first parts of n sheets at the holding zone; and, means for drawing away the n sheets from the stack as a set, to thereby provide a lift of n whole sheets.

2. The apparatus of claim 1 wherein the means for drawing away the n sheets from the stack moves the n sheets transversely to the stack axis.

3. The apparatus of claim 1 further comprising means for bending away as a set from the end of the stack and toward the holding zone second sheet parts of the n sheets, after the first parts of n sheets have been bent away, received and retained in the holding zone, and prior to drawing away of the n sheets from the stack.

4. The apparatus of claim 3 wherein the stop has a yieldable portion and a fixed portion; the yieldable portion moving when the second sheet parts of the set are bent away from the end of the stack; and, the fixed portion keeping remainder parts of the sheet set in contact with the stack and the base while the sheet second parts are bent away.

5. The apparatus of claim 3 wherein the means for bending away the second sheet parts comprises a wedge translatable into an axial space between the bent away first part of the nth sheet and the rest of the stack.

6. The apparatus of claim 4 wherein the stop yieldable portion is comprised of a plate hingedly attached to the fixed portion.

7. The apparatus of claim 1 wherein the means for removing the n sheets as a set from the stack is comprised of:

translatable nip rollers; means for rotating the rollers; means for moving the rollers to capture therebetween the first parts of the set of n sheets and to create frictional force between the sheets of the set by pressing respectively on the nth and first sheets, the force sufficient to draw all the sheets of the set transversely from the end of the stack when the rollers are rotated.

8. The apparatus of claim 1 wherein the means for drawing away the n sheets as a set from the stack is comprised of: translatable nip rollers; means for rotating the rollers; means for translating the rollers toward the bent away first parts of the set of n sheets in the holding zone, the nip rollers creating frictional force between the sheets of the set by pressing the nth and first sheets toward each other, the frictional force sufficient to draw all the sheets of the set transversely from the end of the stack when the rollers are rotated.

9. The apparatus of claim 1 wherein the means for serially bending away the first parts of the successive n sheets from the end of the stack comprises a head having means to attract each successive sheet first part to a surface thereof, the head movably mounted on the base and reciprocating axially between the end of the stack and the holding zone, to pull successive sheet first parts to the holding zone.

10. The apparatus of claim 9 wherein the means to attract each successive sheet first part to the surface of the head is comprised of a vacuum port on the side of the head facing the stack, so atmospheric pressure forces each sheet to the head surface when the head comes close to the sheet.

11. The apparatus of claim 10 wherein the head has a rotatable stripper bar attached thereto, rotation of the bar moving the bent away first part of each sheet from the vacuum port side of the head to the opposing side of the head, and away from the end of the stack.

12. The apparatus of claim 1 further comprising a means for reading information on sheets during the bending and holding step, and for producing a signal responsive thereto; and, means for controlling the actions of the means for serially bending and the holding means, responsive to said signal.

13. The apparatus of claim 1 further comprising means for producing a signal responsive to proximity of the stack to the stop; and, means for axially feeding the stack toward the stop responsive to the signal.

14. The apparatus of claim 1 wherein the base has a surface sloped downwardly toward the stop, for supporting the stack of sheets thereon; and, wherein the means for axially feeding includes movable frictional belting on the base surface.

15. A method of providing a lift of n sheets from a stack of sheets having an axis perpendicular to the faces of the sheets which comprises:

pressing an end of a stack of sheets axially against a stop;

bending a first part of a first sheet away from the end of the stack and holding the first part in a holding zone axially spaced apart from the end of the stack, while keeping the remainder of the sheet in the stack;

similarly and serially bending and holding first parts of succeeding sheets of the stack, while keeping the remainders of the succeeding sheets in the stack, until the first parts of n sheets are accumulated and held in the holding zone;

bending toward the holding zone, as a set, second parts of the n sheets, so the second and first parts of the n sheets are held together in the holding zone;

drawing away transversely to axis of the stack as a set the n sheets, to thereby provide a lift of n sheets;

advancing the remaining sheets in the stack toward the stop;

wherein the step of drawing away of the set comprises pressing by means of opposing rollers the first and nth sheets toward each other, and pulling at least one of said first or nth sheets transversely from the stack by rotation of at least one of the opposing rollers; wherein the force of pressing of the first and nth sheets toward each other is sufficient to create frictional drag amongst the n sheets, so all n sheets are by frictional engagement with each other drawn transversely from the stack as a set.

16. The method of claim 15 wherein the step of bending toward the holding zone comprises bending the second parts of the n sheets by means of a wedge which contacts said second parts.

17. The method of claim 15 wherein the first part of the first sheet and the first parts of succeeding sheets comprise the corner and corners, respectively, thereof; and wherein the second parts of the n sheets comprise other corners, so the second and first parts of sheets held together in the holding zone comprise nominal end halves of the sheets.

* * * * *